US008382217B2

(12) United States Patent
Craig et al.

(10) Patent No.: US 8,382,217 B2
(45) Date of Patent: Feb. 26, 2013

(54) KITCHEN UNIT ARRANGEMENT

(75) Inventors: James William Craig, Wakefield (GB); Stuart Hutchinson, Pontefract (GB)

(73) Assignee: The Moores Furniture Group Limited, West Yorkshire (GB)

( * ) Notice: Subject to any disclaimer, the term of this patent is extended or adjusted under 35 U.S.C. 154(b) by 498 days.

(21) Appl. No.: 12/252,987

(22) Filed: Oct. 16, 2008

(65) Prior Publication Data

US 2009/0108718 A1 Apr. 30, 2009

(30) Foreign Application Priority Data

Oct. 17, 2007 (GB) ..... 0720239.3

(51) Int. Cl.
*A47B 47/00* (2006.01)

(52) U.S. Cl. ..... 312/257.1; 312/228; 126/37 R

(58) Field of Classification Search ..... 312/257.1, 312/237, 294, 330.1, 321.5, 351.1, 351.3, 312/140.3, 228, 195; 126/29, 37 R
See application file for complete search history.

(56) References Cited

U.S. PATENT DOCUMENTS

| | | | | | |
|---|---|---|---|---|---|
| 1,066,006 | A | * | 7/1913 | Forgy | 312/210.5 |
| 2,338,727 | A | * | 1/1944 | Mastrangelo | 312/195 |
| 2,349,541 | A | * | 5/1944 | Earle | 126/299 R |
| 2,485,359 | A | * | 10/1949 | Cook et al. | 126/39 B |
| 2,633,998 | A | * | 4/1953 | Derman et al. | 211/104 |
| 2,790,694 | A | * | 4/1957 | Palmer | 312/306 |
| 2,839,044 | A | * | 6/1958 | Phares | 126/39 C |
| 3,051,160 | A | * | 8/1962 | Nielsen | 126/37 R |
| 3,142,295 | A | * | 7/1964 | Blee | 126/37 R |
| 3,176,677 | A | * | 4/1965 | McArthur, Jr. | 126/37 R |
| 3,213,847 | A | * | 10/1965 | Scott | 126/37 R |
| 3,376,861 | A | * | 4/1968 | Bach, Jr. | 126/37 R |
| 3,790,750 | A | * | 2/1974 | Giannini | 219/452.13 |
| 3,950,049 | A | * | 4/1976 | Drass | 312/245 |
| 3,971,605 | A | * | 7/1976 | Sasnett | 312/198 |
| 4,221,441 | A | * | 9/1980 | Bain | 312/228 |
| 4,489,996 | A | * | 12/1984 | Norton et al. | 312/279 |
| 4,799,743 | A | * | 1/1989 | Kikuchi et al. | 312/228 |
| 5,795,041 | A | * | 8/1998 | Weaver | 312/205 |
| 6,293,272 | B1 | * | 9/2001 | Harneit | 126/37 B |
| D475,552 | S | * | 6/2003 | Thompson | D6/432 |
| 2002/0014484 | A1 | * | 2/2002 | Caruso | 219/521 |
| 2004/0012311 | A1 | * | 1/2004 | Nielsen | 312/205 |
| 2005/0088063 | A1 | * | 4/2005 | Cox | 312/140.3 |

* cited by examiner

*Primary Examiner* — James O Hansen
(74) *Attorney, Agent, or Firm* — James B. Conte; Husch Blackwell LLP

(57) ABSTRACT

A kitchen unit arrangement (10) having three or more storage units (12, 14, 16), the arrangement comprising first and second end walls (22) and at least two internal walls (20), the first end wall and a first said internal wall together defining a first said storage unit (12), the second end wall and a second said internal wall together defining a second said storage unit (14); wherein two of said internal walls (20) are connected by a substantially horizontal shelf (26) to define a third storage unit (16). A method of assembling such a kitchen unit apparatus is also provided.

10 Claims, 10 Drawing Sheets

KITCHEN UNIT ARRANGEMENT

TECHNICAL FIELD OF THE INVENTION

This invention relates to a kitchen unit arrangement and a method of installing a kitchen unit arrangement.

BACKGROUND TO THE INVENTION

When constructing a new dwelling, a considerable amount of time and money is spent fitting out the kitchen. Indeed, the installation cost of kitchen fittings may be as high as around 50% of the overall cost of the kitchen.

Currently, kitchens are fitted using storage units, for example cupboard units and drawer units, and appliance units selected from a large number of available units. These units are located side by side and may be combined in many different ways to achieve a desired layout of the fitted kitchen. However, this means that many different items have to be ordered and fitted.

An aim of the present invention is to reduce the time taken to install a kitchen. A further aim of the present invention is to reduce the cost of the kitchen fittings.

A further aim of the present invention is to address the problems of the prior art as described herein or elsewhere.

SUMMARY OF THE INVENTION

According to the present invention there is provided an apparatus and method as set forth in the appended claims. Preferred features of the invention will be apparent from the dependent claims, and the description which follows.

According to a first aspect of the present invention there is provided a kitchen unit arrangement having three or more storage units, the arrangement comprising first and second end walls and at least two internal walls, the first end wall and a first said internal wall together defining a first said storage unit, the second end wall and a second said internal wall together defining a second said storage unit; wherein two of said internal walls are connected by a substantially horizontal shelf to define a third storage unit.

Preferably, the shelf is adapted to support an electrical appliance.

Preferably, the electrical appliance is a built-in appliance and may be an oven.

Preferably, the substantially horizontal shelf is a top surface of a box-section.

Preferably, the box-section is bolted to the respective internal walls.

Preferably, the box-section contains a drawer.

Preferably, the first and second end walls are each decorative single panels. Thus the external side walls may be both structural and decorative.

Preferably, the kitchen unit arrangement comprises a worktop.

Preferably, the external side walls extend above the worktop to form respective side upstands to the worktop.

Preferably, the first and second storage units are cupboard units.

Preferably, a space below the shelf is adapted to accommodate a drawer.

Preferably, the kitchen unit arrangement comprises a rear upstand to the worktop.

Preferably, the worktop is 700 mm deep. Preferably, the worktop has pre-cut apertures for receiving a sink and/or a pop-up socket and/or a hob. Preferably, all edges of the worktop are sealed.

Preferably, a sink is provided with a clip-on drainer. The drainer may be adapted to be placed over the bowl when the worktop is required for food preparation. Preferably, the clip-on drainer is glass and is usable as a food preparation surface.

Preferably, a pop-up socket unit is mounted to the kitchen unit arrangement. The socket unit may mounted so that in use it extends upwardly of the worktop, whilst when not required it can be retracted to the level of the worktop.

Preferably, the kitchen unit arrangement has a plinth which is between 60 mm to 80 mm in height and most preferably 60 mm in height. The plinth may be a plastic profile. The profile may comprise ventilation apertures for ventilating the electrical appliance. The profile may be designed to be adjustable for uneven floors without the need to cut the plinth.

Preferably, a drawer is provided below the appliance shelf, and may be operated by a push catch.

Preferably, at least one storage unit is provided with a door and a gap is provided between the top of the respective door and the worktop to allow the door to be opened. This means that the doors do not have handles. A rail may be located behind the gap to prevent a user from seeing into storage unit when the door is shut.

Preferably, at least one of the storage units is provided with one or more slide-out cutlery trays.

Preferably, at least one of the storage units is provided with one or more swivel-out cutlery trays.

Preferably, at least one of the storage units is provided with one or more cutlery trays adapted to be attached to the top of the door.

Preferably, adjustable legs are provided to enable the level of the arrangement to be adjusted on uneven floors.

According to a second aspect of the present invention there is provided a kitchen unit arrangement comprising a first storage unit, a substantially vertical support means and a shelf mounted between an inner side wall of the storage unit and the support means for supporting an electrical appliance.

Preferably, the electrical appliance is a built-in appliance and may be an oven.

Preferably, the support means may be part of a second storage unit, the support means forming the inner side wall of the second storage unit.

Preferably, all parts are prefabricated.

According to a third aspect of the invention there is provided a method of assembling a kitchen unit arrangement having three or more storage units, the kitchen unit arrangement comprising first and second end walls, at least two internal walls and a shelf; the method comprising: connecting the first end wall to a first said internal wall to form a first storage unit; connecting the second end wall to a second said internal wall to form a second storage unit; and connecting two of said internal walls by means of a shelf to form a third storage unit between the first and second internal walls.

Preferably, the method further comprises connecting the first and second storage units by means of a rear panel.

Preferably, the kitchen unit arrangement further comprises a worktop and the rear panel is a rear upstand to the worktop.

Preferably, the method further comprises installing a built-in electrical appliance which is supported by the shelf.

According to a fourth aspect of the invention there is provided a kitchen storage unit having two side walls, one or both of the side walls being a decorative single panel. Each side wall is thus both structural and decorative.

Preferably, one or both side walls extend above a level at which a worktop is to be located, each side wall forming a side upstand to the worktop.

According to a fifth aspect of the invention there is provided a kitchen storage unit having a plinth which is between 60 mm and 80 mm in height and most preferably 60 mm in height.

According to sixth aspect of the invention there is provided a kitchen storage unit having a cutlery tray that is located at the top of the storage unit or directly below a shelf of the storage unit.

Preferably, the cutlery tray may be slidably mounted in the storage unit. Alternatively, the cutlery tray may be pivotally mounted in the storage unit.

Alternatively, the cutlery tray may be mounted on a door of the storage unit. Preferably, the cutlery tray is provided with at least one hook which is mounted over the top edge of the door. Alternatively, the cutlery tray may be provided with at least one bracket which cooperates with bracket receiving means attached to the door of the storage unit The present invention includes any combination of features or limitations as herein referred to.

BRIEF DESCRIPTION OF THE DRAWINGS

For a better understanding of the invention, and to show how embodiments of the same may be carried into effect, reference will now be made, by way of example, to the accompanying diagrammatic drawing, in which.

DESCRIPTION OF THE PREFERRED EMBODIMENT

Figure 1:
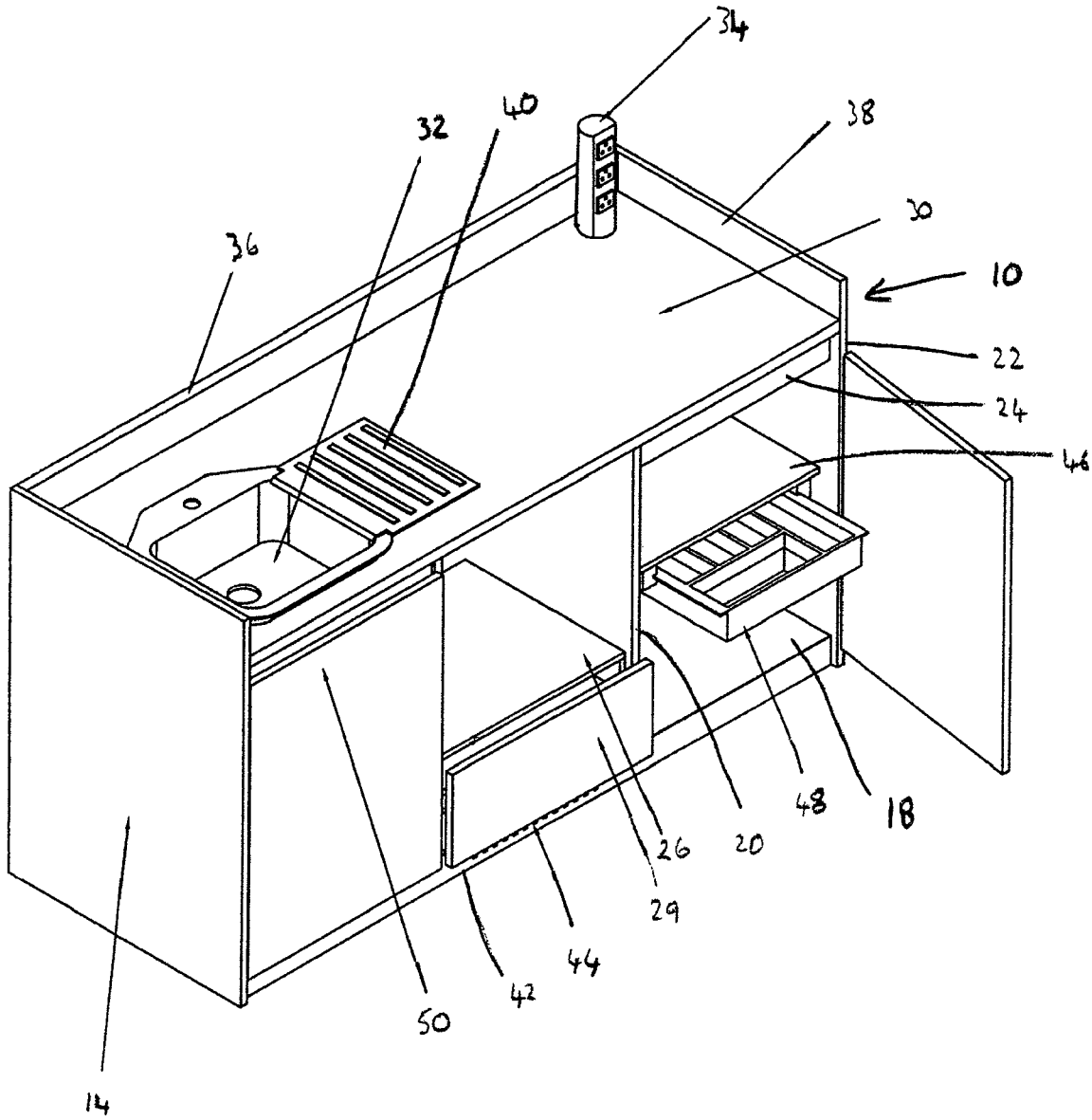
FIG. 1 shows a perspective view of a partially finished kitchen unit module according to a first embodiment of the present invention.
Figure 2:
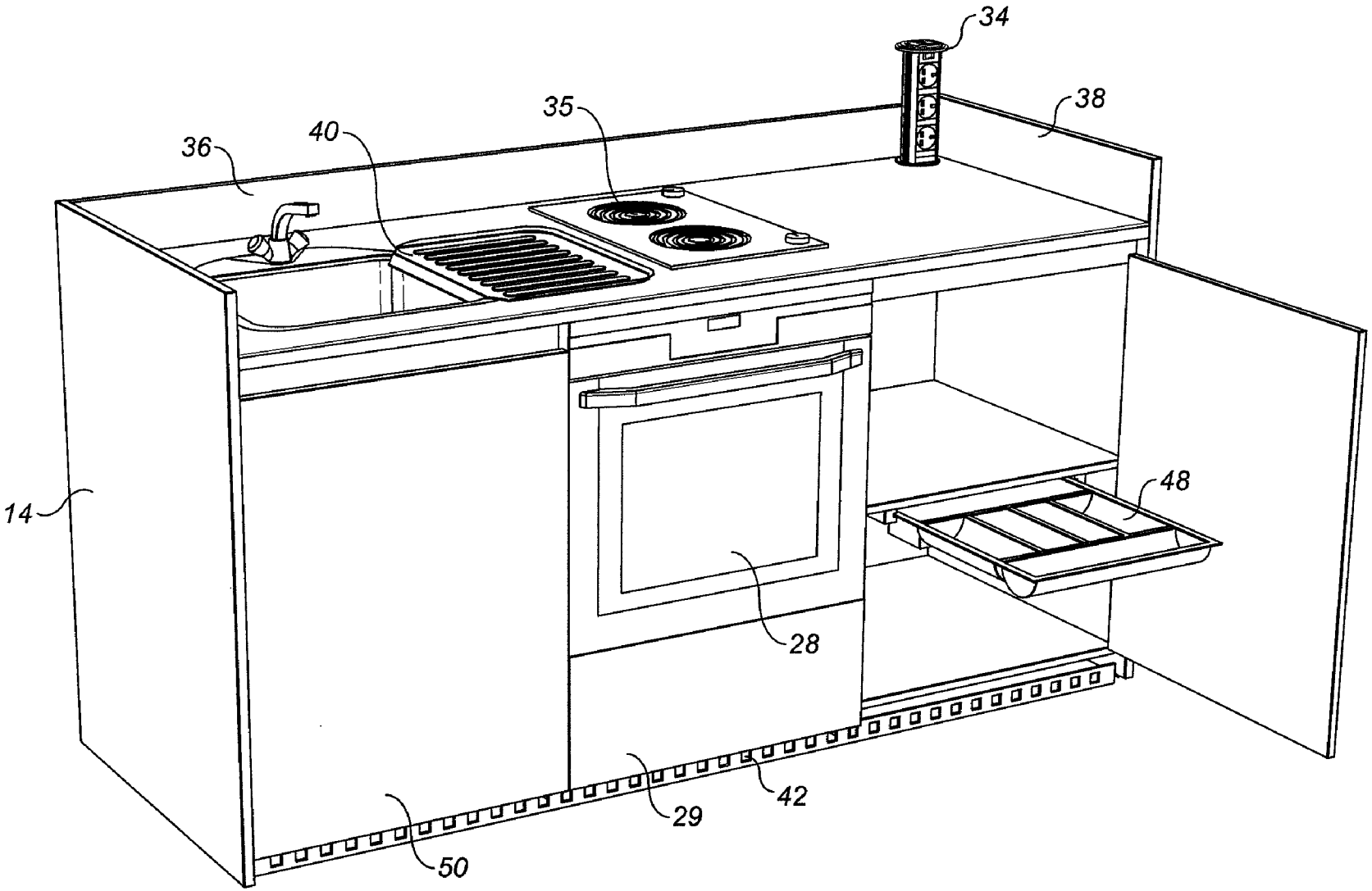
FIG. 2 shows a perspective view of a finished kitchen unit module according to a second embodiment of the present invention.
Figure 3A:
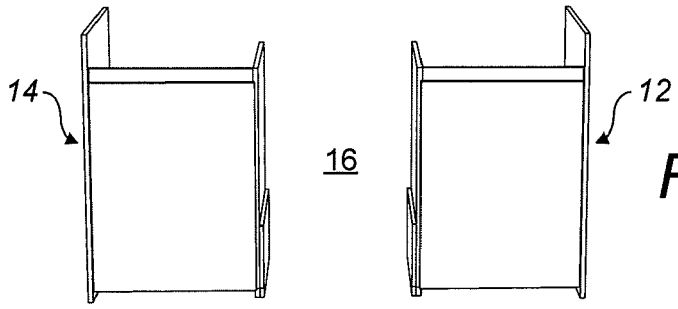
FIGS. 3*a-e* show some of the stages of construction of the kitchen unit module of FIG. 2.
Figure 3B:
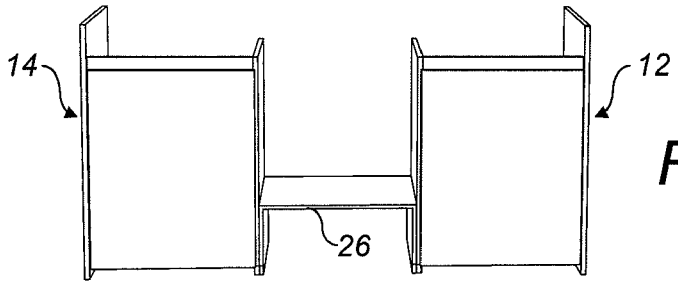
Figure 3C:
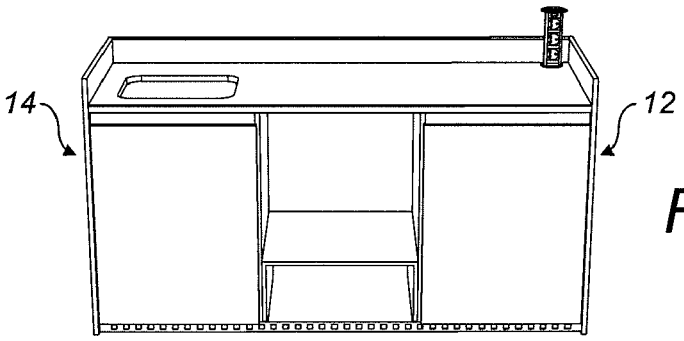
Figure 3D:
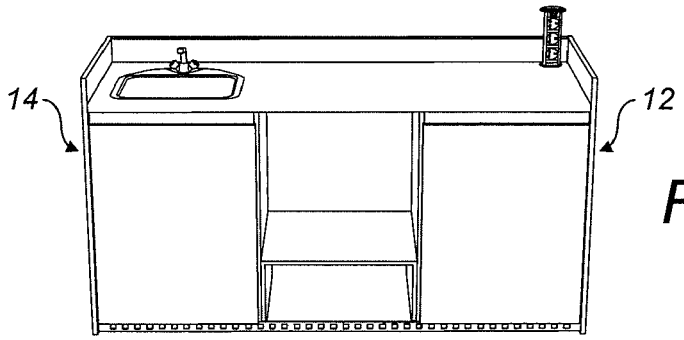
Figure 3E:
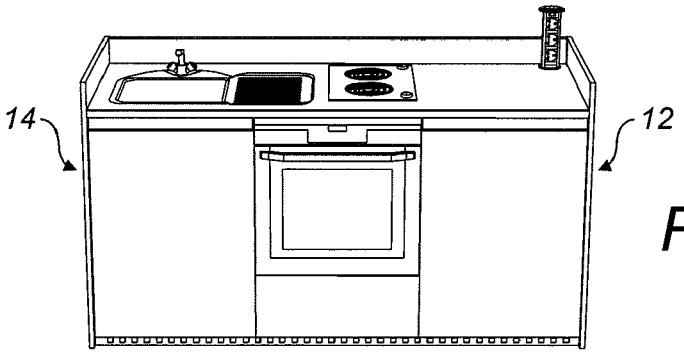

FIG. 1-3 show a kitchen unit module 10 comprising two storage units in the form of cupboard units 12, 14 and a space 16 for mounting an oven 28.

Each cupboard unit 12,14 comprises a base 18, an internal side wall 20 and an external side wall 22. The external side walls 22 are preferably decorative. A rail 24 is located between the internal and external side walls 20, 22 at the top front portion of the cupboard units 12,14.

An oven shelf 26 is mounted between the two interior side walls 20 of the cupboard units 12,14. The oven shelf 26 is thus supported by the two cupboard units 12,14 and spans the gap between them. The space above the oven shelf 26 is adapted to receive the oven 28, whilst the space below the oven shelf 26 is adapted to accommodate a drawer 29. The use of an oven shelf means that a conventional oven unit is not required. This has the is advantage that fewer materials are used, in particular the two side walls of an oven unit are not required. This reduces the cost of the kitchen unit module compared with conventional kitchen unit arrangements.

In an alternative embodiment not shown, the shelf is a top surface of a box-section. The box-section is bolted to the respective two interior side walls 20 to create a more solid structure. In this embodiment, the box-section accommodates the drawer 29.

A worktop 30 is located on the cupboard units 12,14. The worktop 30 is supplied to site already cut to size and with the cut-outs for a sink 32 and a pop-up socket unit 34 already machined. A hole for a hob 35 is also shown in FIG. 2. All edges of the worktop 30 are preferably sealed.

A rear upstand 36 is incorporated into the kitchen unit module. The rear upstand 36 obviates the need for the installer to tile behind the worktop, and thus speeds up installation. The upstand 36 is delivered to site cut to size and is preferably produced from the off-cut of the worktop 30. Preferably, a standard 900 mm double postformed worktop 30 is used, and cut down to 700 mm. This means that the upstand 36 is 80 mm. The worktop 30 is relatively deep at 700 mm, whereas conventional worktops are 600 mm. There are two main benefits to this: additional worktop area without increasing the width of the kitchen; and additional storage space in the cupboards.

The external side walls 22 extend above the worktop 30 to form side upstands 38 around the worktop. In a standard kitchen framing walls are provided which are additional elements clad onto the side of the kitchen units. The use of the extended external side walls 22 of the present invention reduces both the cost and material content of the kitchen.

The sink 32 is a single bowl with a plastic clip-on drainer 40. This arrangement has the benefit of providing a draining area without occupying valuable worktop area. The drainer 40 can be placed over the sink 32 when the worktop is required for food preparation. In one embodiment, the clip-on drainer is glass and may also be used as a chopping surface.

The pop-up socket unit 34 is also integrated into the kitchen unit module 10. The socket unit 34 is mounted so that in use it extend upwardly of the worktop 30, whilst when not required it can be pushed down below the level of the worktop 30. The socket unit 34 may contain several sockets which are connected to a single socket located on the wall behind the unit.

A plinth 42 is located along the front of the base of the kitchen unit module 10. A plastic profile is preferably used as the plinth 42. The profile has ventilation grooves 44 incorporated for the oven 28 and can be easily modified for uneven floors. The ventilation grooves may be provided in the area under the oven, as shown in FIG. 1, or along the length of the plinth, as shown in FIG. 2.

The plinth 42 is preferably 60 mm in height, which is small compared with conventional kitchen units. The reduction in plinth height allows for the drawer 29 to be relatively deep under the oven creating additional storage. The drawer 29 is operated by a push catch which eliminates the need for a handle.

Furthermore the design of the kitchen unit module means that cupboard units 12,14 also have maximal storage space. As set out above, the cubic capacity of the cupboard units 12,14 has been increased above that of standard units by increasing the depth by 100 mm and reducing the height of the plinth to 60 mm.

Each cupboard unit 12,14 is provided with a shelf 46. A slide-out cutlery tray 48 is used in place of a conventional drawer. This allows for the storage of cutlery without the cost of a drawer system.

Each cupboard unit 12,14 has a cupboard door 50 which does not extend up to the worktop 30. The gap between the top of the door 50 and the worktop is sufficient to allow the door to be opened without the need for handles. Avoiding the use of handles reduces the number of components required in the module. The fingers of a user are inserted into the gap to engage the top of the door such that the door can be opened. The top rail 24 of the cupboard unit 12,14 is located so that the user cannot see into the cupboard when the door 50 is shut, but can still open the door with his fingers.

Adjustable legs (not shown) may be incorporated into the design of the kitchen unit module 10 to allow for adjustment on uneven floors.

Figure 4A:
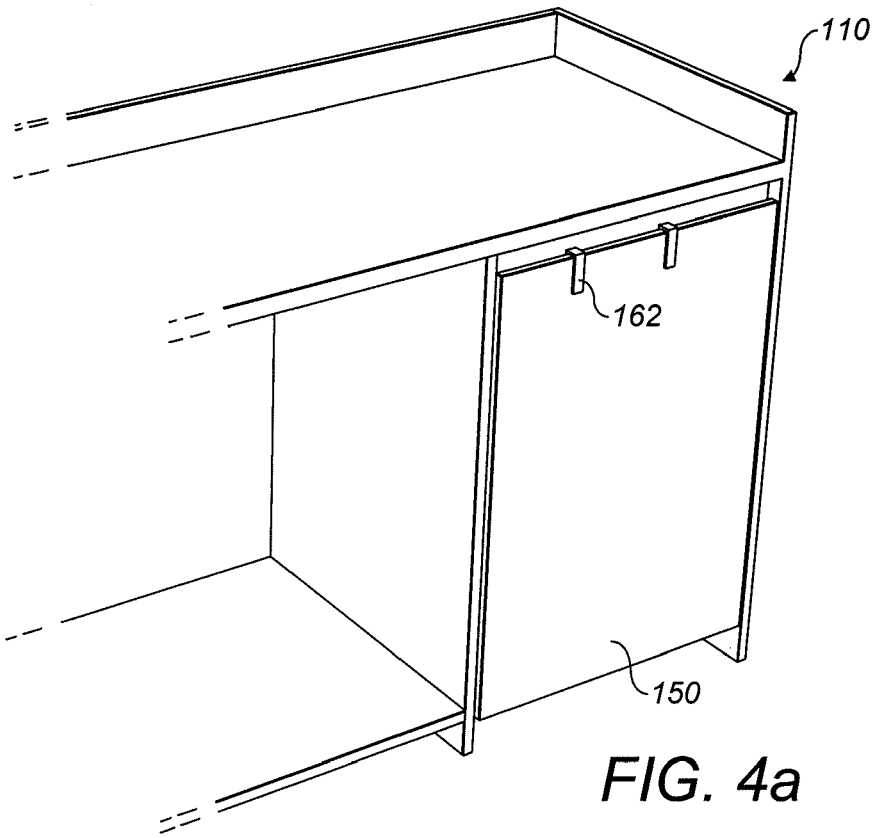
FIGS. 4*a-b* show a partial perspective view of a partially finished kitchen unit module having a hook-on cutlery tray according the present invention.
Figure 4B:
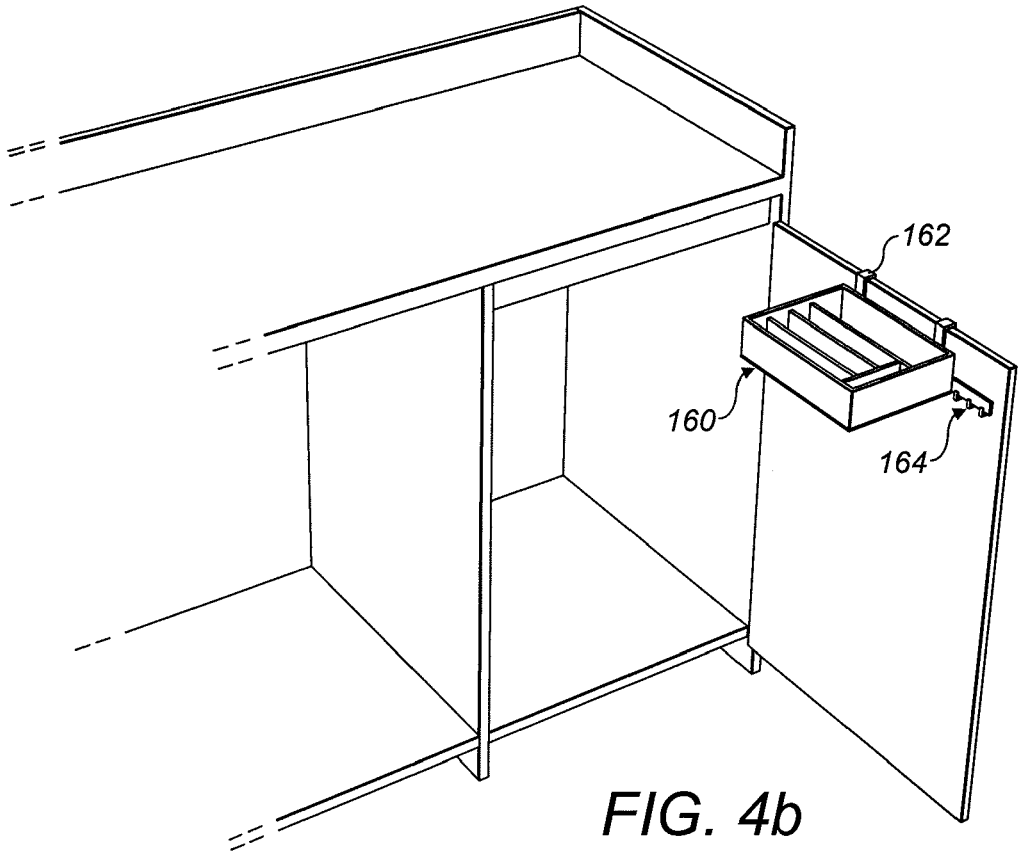

FIGS. 4*a,b* show a kitchen unit module 110 having an alternative arrangement for accommodating a cutlery tray 160. The cutlery tray 160 is removably mounted on a door 150 by means of two hooks 162 extending over the top of the door 150. The tray is provided with an arm 164 having plurality of hooks from which kitchen utensils, kitchen towels and the like may by hung.

Figure 5A:
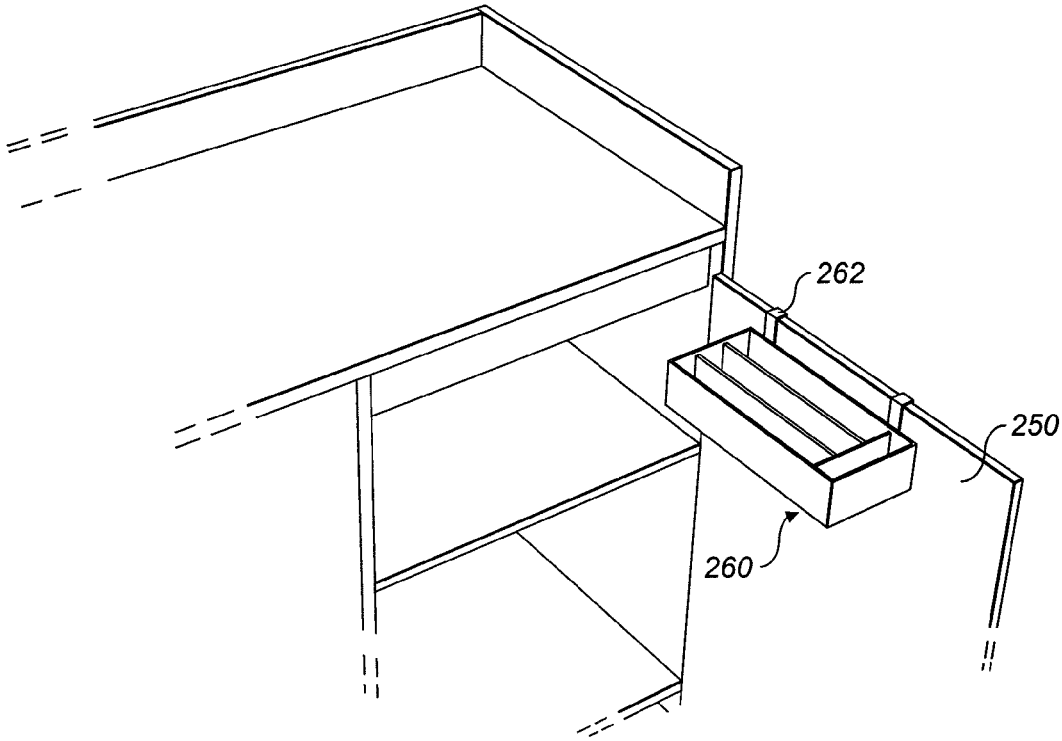
FIGS. 5*a-b* show a partial perspective view of a partially finished kitchen unit module having an alternative hook-on cutlery tray according to the present invention.
Figure 5B:
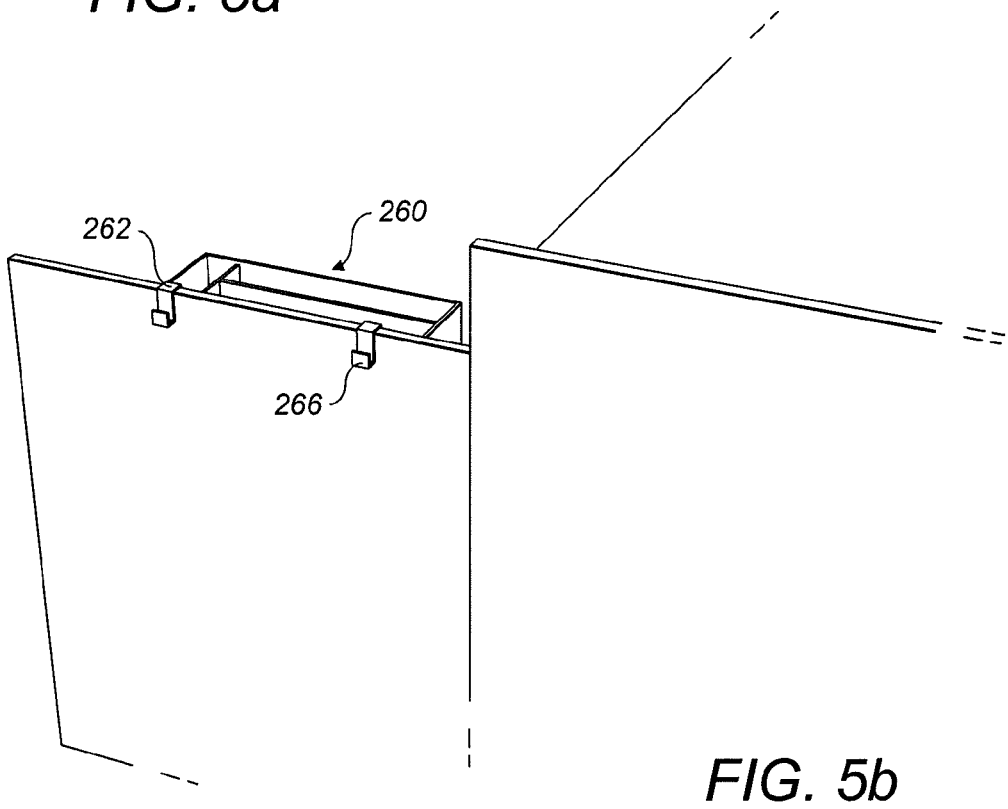
Figure 6:
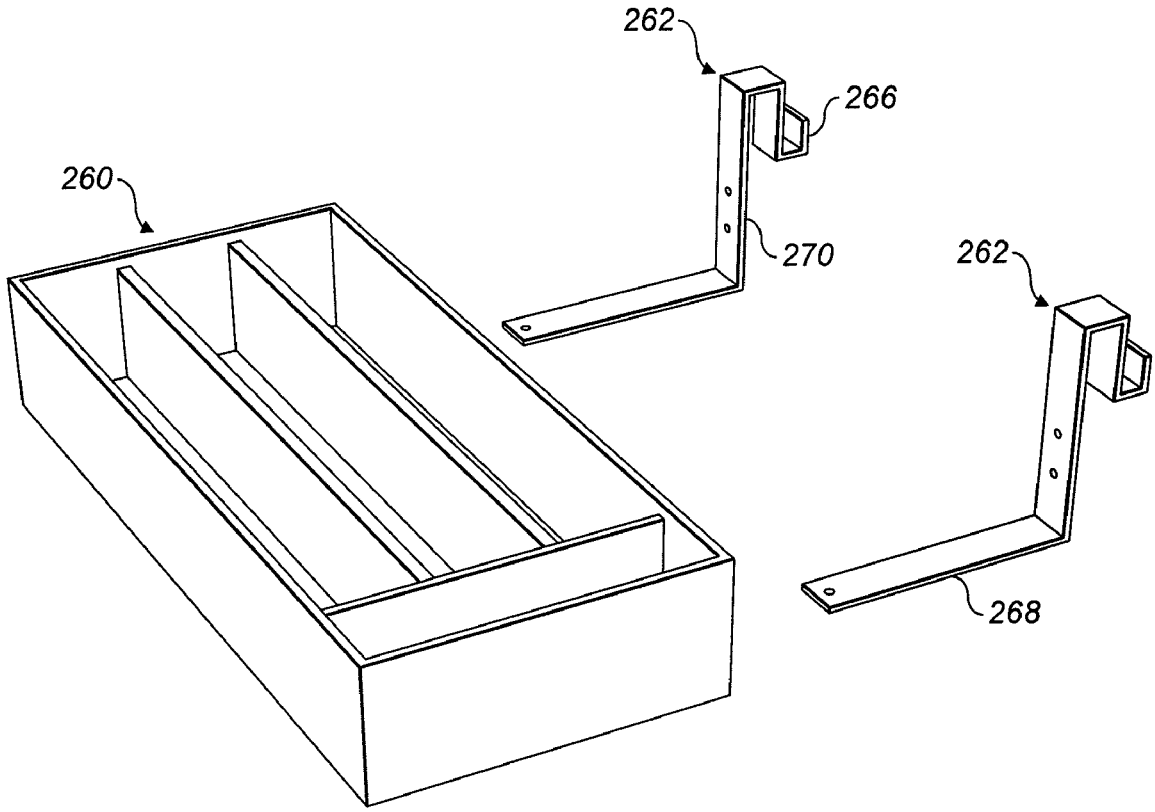
FIG. 6 shows the cutlery tray and the mounting hooks of FIGS. 5*a-b*.

FIGS. 5*a,b* and 6 show an alternative cutlery tray 260 removably mounted on a door 250 by means of two hooks 262 extending over the top of the door 250. The hooks 262 extend upwardly at first ends 266 distant from the cutlery tray to provide hooks external to the door for hanging kitchen towels and the like. FIG. 6 shows the support arrangement for the cutlery tray in more detail. Portions 268 and 270 at the other end of the hooks 262 extend down a side of the cutlery tray 260 and under the base of the cutlery tray respectively. The portions 268 and 270 are attached to the cutlery tray 260 by means of screws, rivets or the like. When the door 350 is closed the cutlery tray 360 is located in a top portion of the cupboard unit 312.

Figure 7A:
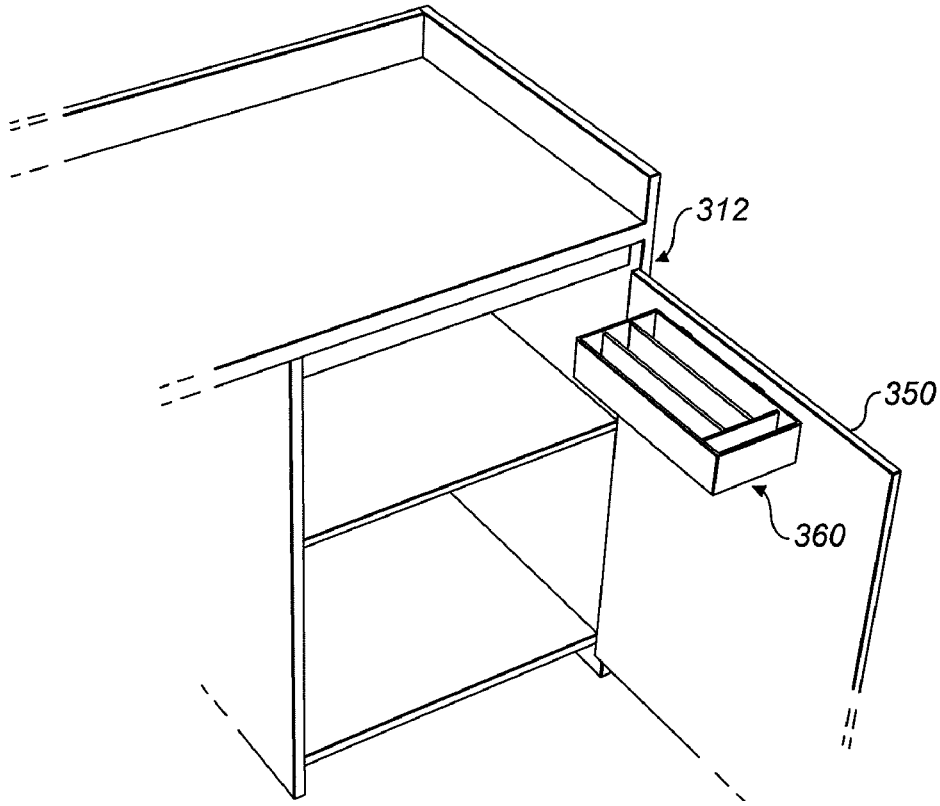
FIGS. 7*a-b* show a partial perspective view of a partially finished kitchen unit module having a further alternative hook-on cutlery tray according to the present invention.
Figure 7B:
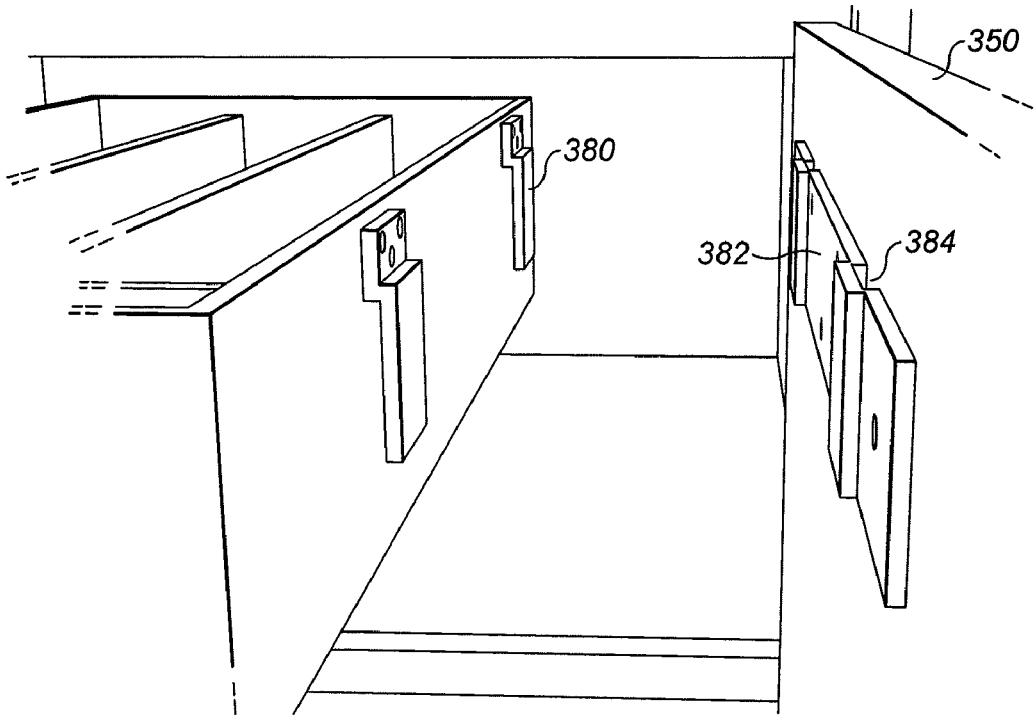
Figure 8:
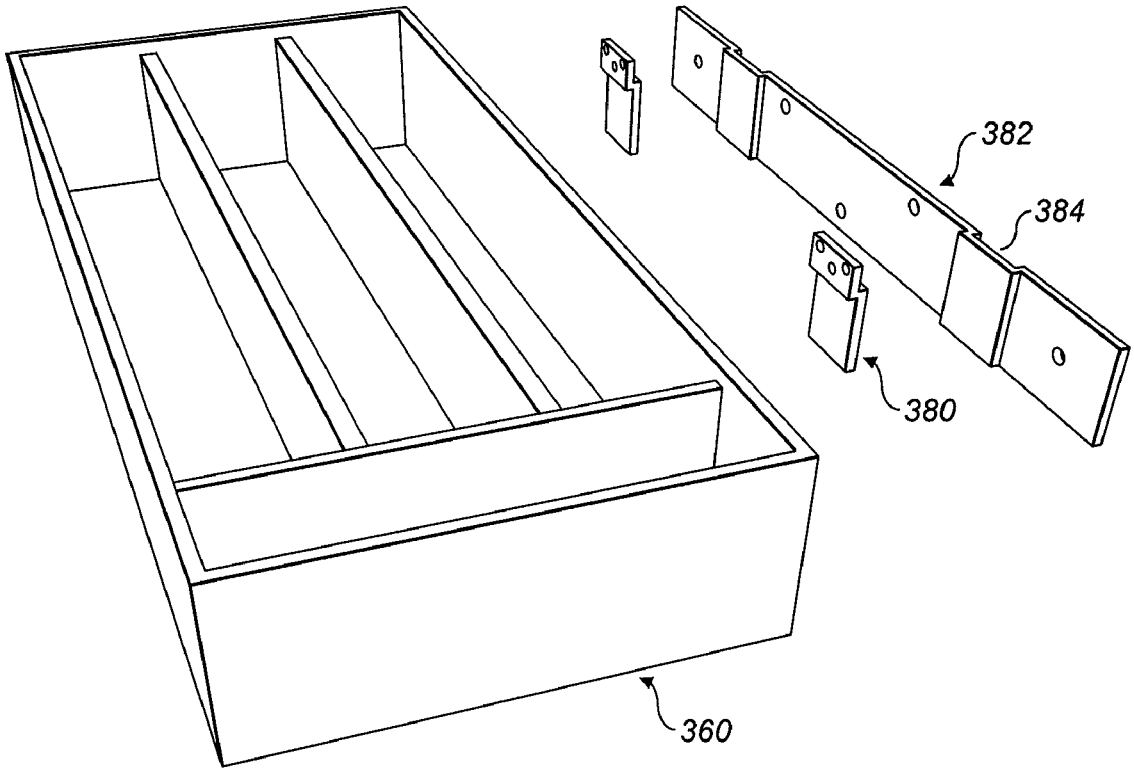
FIG. 8 shows the cutlery tray and the mounting hooks of FIGS. 7*a-b*.

FIG. 7*a,b* show a still further cutlery tray 360 removably mounted on a door 350. FIG. 8 shows the mounting arrangement in more detail. The cutlery tray 360 is provided with two brackets 380 attached to one side thereof. The door 360 is provided with a bracket receiving means 382 comprising two bracket receiving slots 384. In use, the brackets 380 are inserted in respective bracket receiving slots 384. When the door 350 is closed the cutlery tray 360 is located in a top portion of the cupboard unit 312.

Figure 9A:
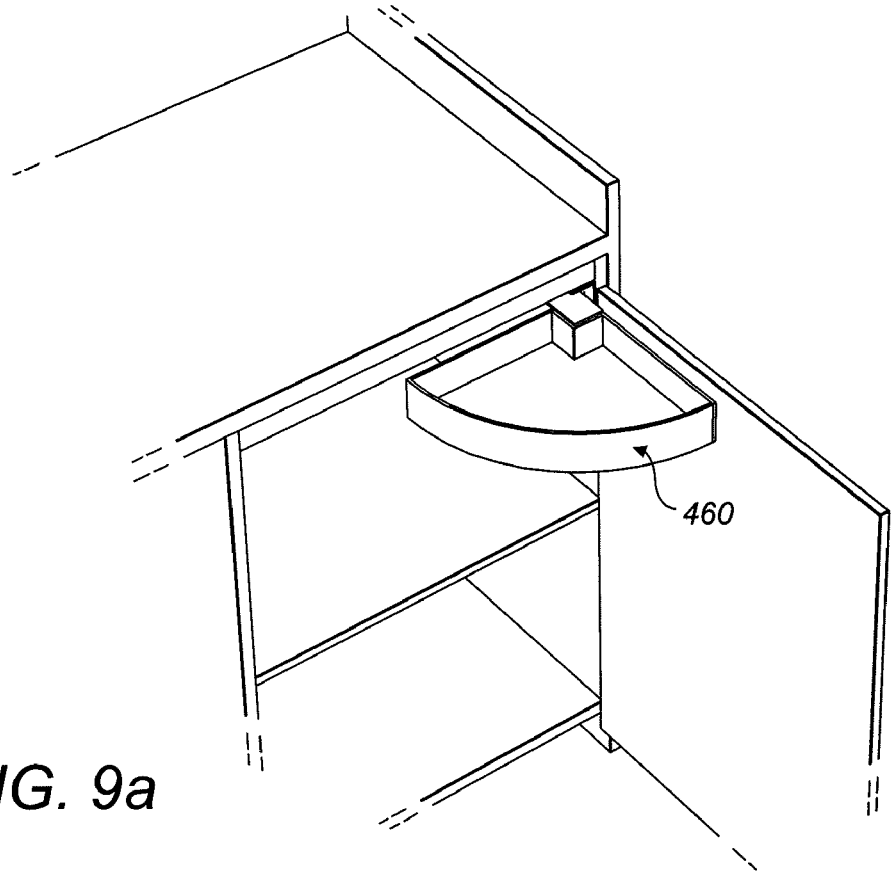
FIGS. 9*a-b* show a partial perspective view of a partially finished kitchen unit module having a pivoting cutlery tray according the present invention.
Figure 9B:
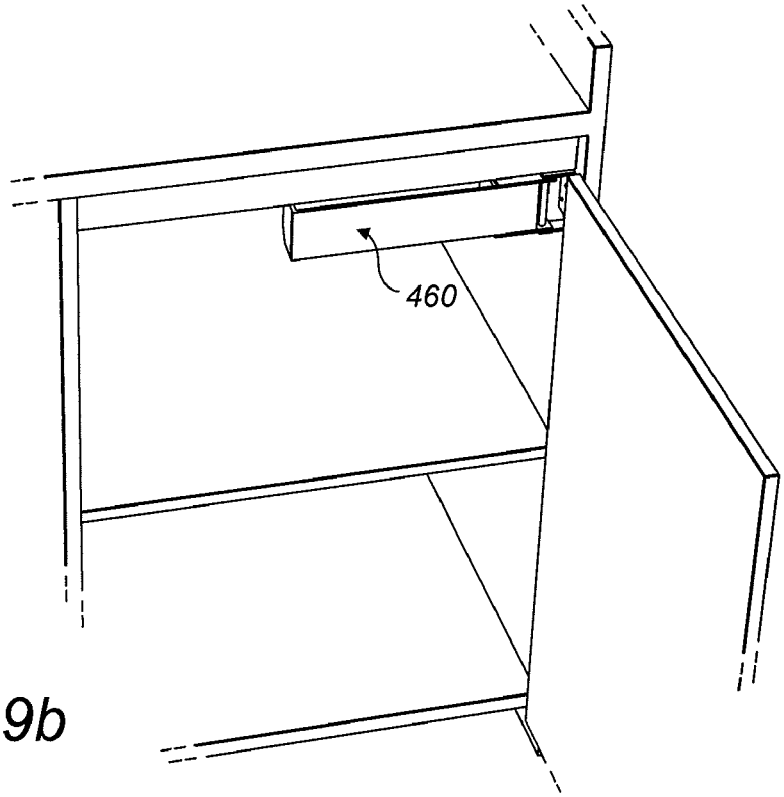
Figure 10:
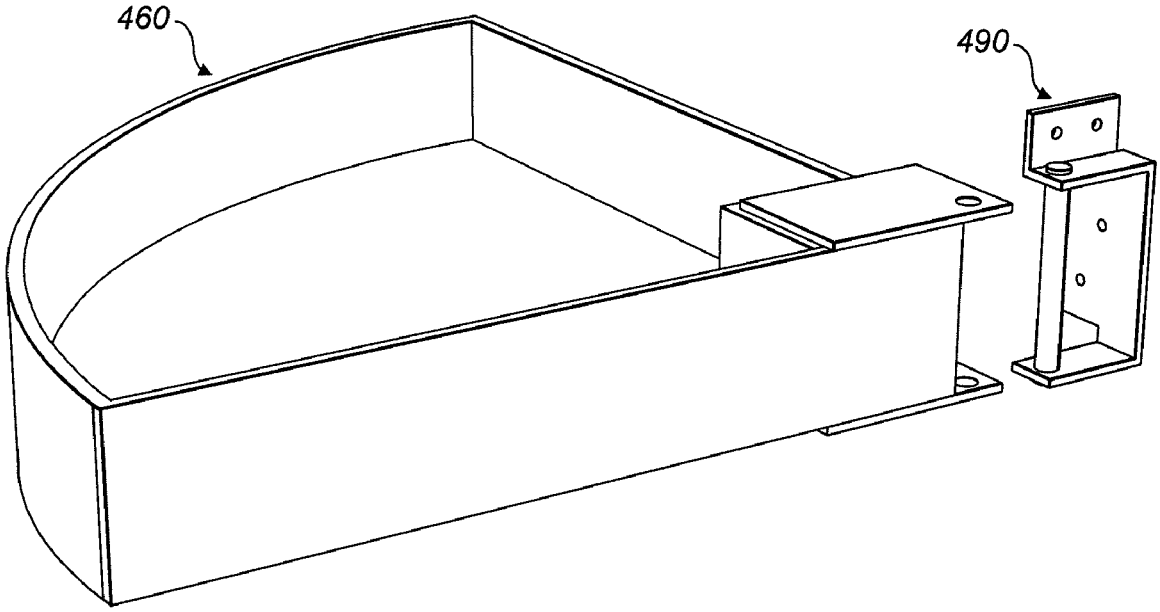
FIG. 10 shows the cutlery tray and the mounting hooks of FIGS. 9*a-b*.

FIG. 9*a,b* show the kitchen module 110 having a still further arrangement for accommodating a cutlery tray 460. FIG. 10 shows the mounting arrangement in more detail. The cutlery tray 460 is mounted on a pivot arrangement 490 at the top and front of a cupboard unit 112 such that when the door 150 is closed the tray is located fully within the unit 112, and when the door is open the tray may be pivoted to extend fully out of the unit 112 to enable access to the contents of the tray 166. The cutlery tray is preferably the shape of a quarter segment of circle, but may be any suitable shape.

The cutlery trays described above are located so that they are accommodated either towards the top of a storage unit or directly below a shelf of a storage unit. In this way, use is made of what otherwise could be wasted space.

By treating the kitchen as a complete product module, it can be designed to be as functional as possible in a compact environment and as cost effective as possible.

The use of a kitchen unit module means that entire selection and installation process is simplified for both the customer and the manufacturer. When building a new house, apartment, or the like, the customer can select a kitchen module from a number of modules which fit that particular kitchen. This will mean that fewer items have to be ordered to create a kitchen resulting in much less likelihood of error in the processing of orders, invoices and deliveries.

The kitchen unit module of the present invention has the advantage that it is quick and easy to install. All materials are cut to size in the factory and, where possible, cut-outs in worktops are factory machined in order to reduce on-site processes. This reduces on-site wastage and speeds up installation.

The kitchen unit module of the present invention also has the advantage that manufacturing costs are reduced. The kitchen unit module reduces significantly the number of parts required to construct the kitchen. For example, in the embodiments of FIGS. 1 to 3, there is no need for a separate oven unit between the two cupboard units. There is also no need for additional panels to form the decorative end walls 22. Thus the number of vertical base carcase walls in a kitchen unit module is reduced from eight to four.

The kitchen unit module will be transported to site in four parts: the first and second cupboard units 12,14, the worktop 30 and a box of parts (for example the sink, taps etc).

The principles of the invention are not limited to kitchen floor units, but can be applied to any furniture unit. For example, the invention applies equally to kitchen floor units as to kitchen wall units.

The present invention is tailored particularly towards the construction industry, but can also be applied to the retail sector.

Although a few preferred embodiments have been shown and described, it will be appreciated by those skilled in the art that various changes and modifications might be made without departing from the scope of the invention, as defined in the appended claims.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extend to any novel one, or any novel combination, of the features disclosed in this specification (including any accompanying claims, abstract and drawings), or to any novel one, or any novel combination, of the steps of any method or process so disclosed.

The invention claimed is:

1. A modular kitchen unit arrangement comprising:

a first storage unit with an internal side wall, and an external side wall; a second storage unit with an internal side wall, and an external side wall;

a worktop on the first and second storage units, said worktop forming a top of said storage units, at least a portion of said worktop extending unbroken from said external wall of said first storage unit to said external wall of said second storage unit, said worktop has a cut out portion adapted to receive a kitchen sink, said cut out over either said first or second storage unit;

a shelf mounted between the internal side walls of said first and second storage units, a portion of said worktop over said shelf, a first open space above said shelf defined by said shelf, said internal side walls of said first and second storage units, and said portion of said worktop over said shelf, a second space below said shelf, said space defined by at least said shelf and said internal side walls of said first and second storage units, said first space having a greater volume than said second space, said external and internal walls having vertically extending surfaces facing towards a front of said kitchen unit arrangement, wherein at least one storage unit is provided with a door and a gap is provided between the top of the respective door and the worktop, said gap including an open space behind said front facing vertical extending surface of said internal and external side wall of said at least one storage unit to allow the door to be opened, and wherein a rail is located behind the gap and open space for preventing a user from seeing into the storage unit when the door is shut.

2. The modular kitchen unit arrangement according to claim 1, wherein the shelf is adapted to support an electrical appliance.

3. The modular kitchen unit arrangement of claim 2, wherein the electrical appliance is a built-in oven.

4. The modular kitchen unit arrangement of claim 1, wherein the external side walls are each decorative single panels.

5. The modular kitchen unit arrangement of claim 1, wherein the external side walls extend above the worktop to form respective side upstands to the worktop.

6. The modular kitchen unit arrangement of claim 1, wherein the arrangement comprises a rear upstand to the worktop.

7. The modular kitchen unit arrangement of claim 1, wherein all edges of the worktop are sealed.

8. The modular kitchen unit arrangement of claim 1, wherein at least one of the storage units is provided with one or more slide-out cutlery trays.

9. The modular kitchen unit arrangement of claim 1, wherein at least one of the storage units is provided with one or more swivel-out cutlery trays.

10. The modular kitchen unit arrangement of claim 1, wherein at least one of the storage units is provided with one or more cutlery trays adapted to be attached to the top of the door.

* * * * *